US007115028B1

(12) United States Patent
Chen

(10) Patent No.: US 7,115,028 B1
(45) Date of Patent: Oct. 3, 2006

(54) COUPLING STRUCTURE FOR GRINDING MEMBERS

(75) Inventor: Lung-Pao Chen, Hsinchu (TW)

(73) Assignee: Sunmatch Industrial Co., Ltd., Hsinchu (TW)

( * ) Notice: Subject to any disclaimer, the term of this patent is extended or adjusted under 35 U.S.C. 154(b) by 0 days.

(21) Appl. No.: 11/113,226

(22) Filed: Apr. 25, 2005

(51) Int. Cl.
*B24B 23/00* (2006.01)

(52) U.S. Cl. ..... 451/360; 451/295; 451/510

(58) Field of Classification Search ..... 451/508, 451/510, 360, 295
See application file for complete search history.

(56) References Cited

U.S. PATENT DOCUMENTS

| | | | | | |
|---|---|---|---|---|---|
| 1,329,857 | A * | 2/1920 | Rosner | ..... | 451/342 |
| 2,842,902 | A * | 7/1958 | Miller et al. | ..... | 451/469 |
| 3,561,173 | A * | 2/1971 | Block | ..... | 451/466 |
| 4,177,611 | A * | 12/1979 | Carr-Rollett | ..... | 451/508 |
| 5,924,208 | A * | 7/1999 | Saeki | ..... | 30/388 |

* cited by examiner

*Primary Examiner*—Robert A. Rose
(74) *Attorney, Agent, or Firm*—Birch, Stewart, Kolasch & Birch, LLP

(57) ABSTRACT

A coupling structure for grinding members adopts a removable structure to fasten a grinding member to a pneumatic tool. One or more grinding member may be mounted on the coupling structure according to requirements. The coupling structure may be used repeatedly to reduce costs.

12 Claims, 4 Drawing Sheets

COUPLING STRUCTURE FOR GRINDING MEMBERS

FIELD OF THE INVENTION

The present invention relates to an improved coupling structure for grinding members and particularly to a removable coupling structure adopted for use on pneumatic tools.

BACKGROUND OF THE INVENTION

The common pneumatic tool aims to provide a driving force through a pneumatic motor to rotate a spindle and drive a grinding member coupled on a distal end of the spindle to perform grinding operation. Refer to FIG. 1 for a conventional grinding member 10 which is coupled with a fastening element 11 in an integrated manner. The fastening element 11 has a screw thread 12 on a distal end to be fastened to a coupling head 22 of a pneumatic tool 20.

As the grinding member 10 and the fastening element 11 are fabricated in an integrated manner, when the grinding member 10 has been used for a period of time and has to be replaced, the fastening element 11 also is discarded. This results in an extra cost. Moreover, with the grinding member 10 and the fastening element 11 formed in an integrated manner, the number of the grinding member 10 is fixed and cannot be increased to meet the actual requirements. The overall practicality is lower.

SUMMARY OF THE INVENTION

Therefore the primary object of the present invention is to provide an improved coupling structure for grinding members that adopts a removable design so that one or more grinding member can be coupled or replaced. And the coupling structure can be used repeatedly. Thus the cost may be reduced.

In order to achieve the foregoing object, the coupling structure according to the invention aims to couple at least one grinding member on a pneumatic tool. It includes mainly a first clamping disk, a second clamping disk and a fastening element. The first clamping disk has a sleeve extended from the center of one side. The sleeve has a first aperture running through the first clamping disk. The second clamping disk has a second aperture in the center to receive the sleeve. The fastening element can run through the first aperture and the second aperture to hold the grinding member between the first clamping disk and the second clamping disk, thereby to fasten the grinding member to the pneumatic tool.

Further scope of the applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
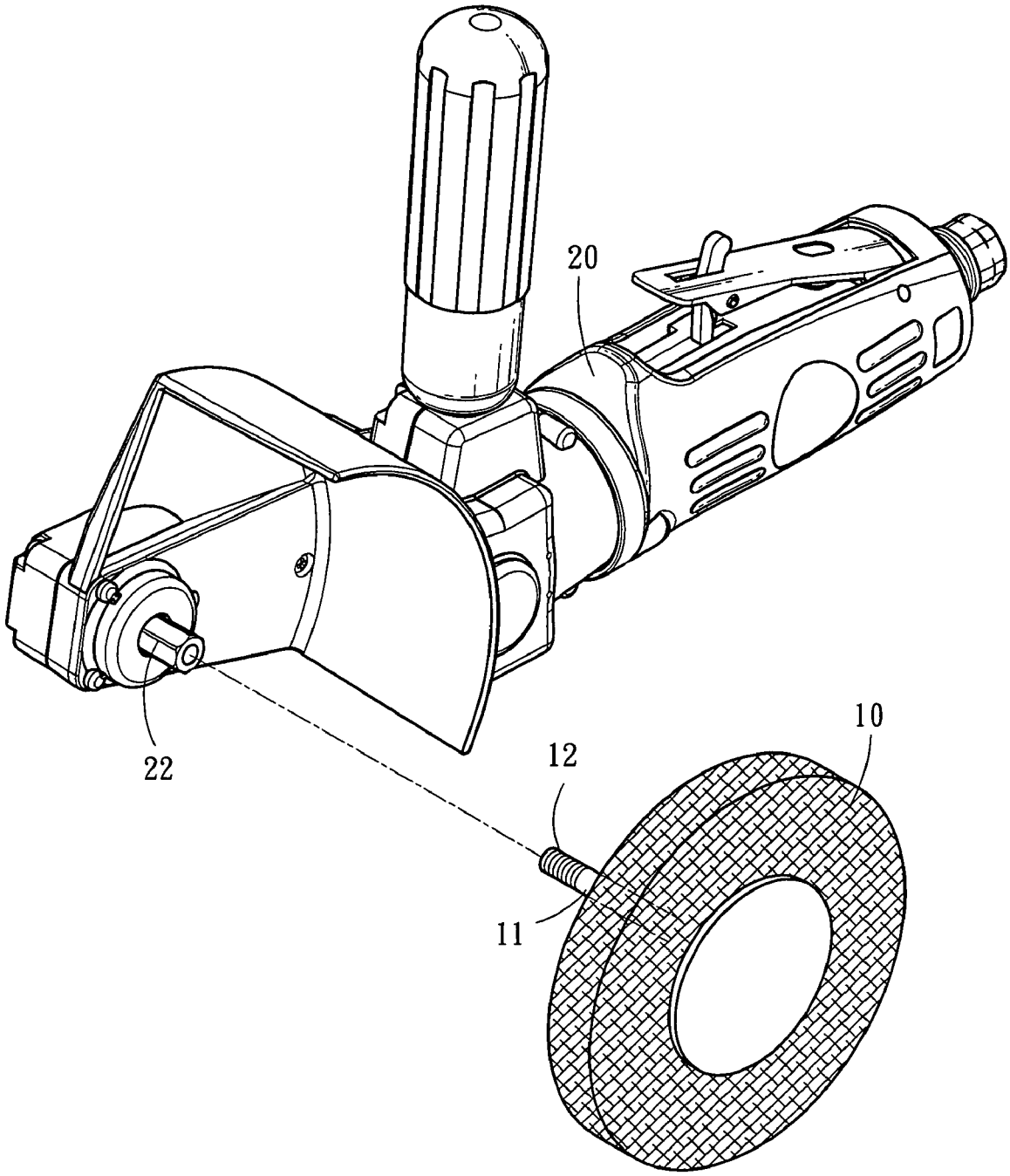
Fig.1 PRIOR ART
FIG. 1 is an exploded view of a conventional grinding member fastened to a pneumatic tool.
Figure 2:
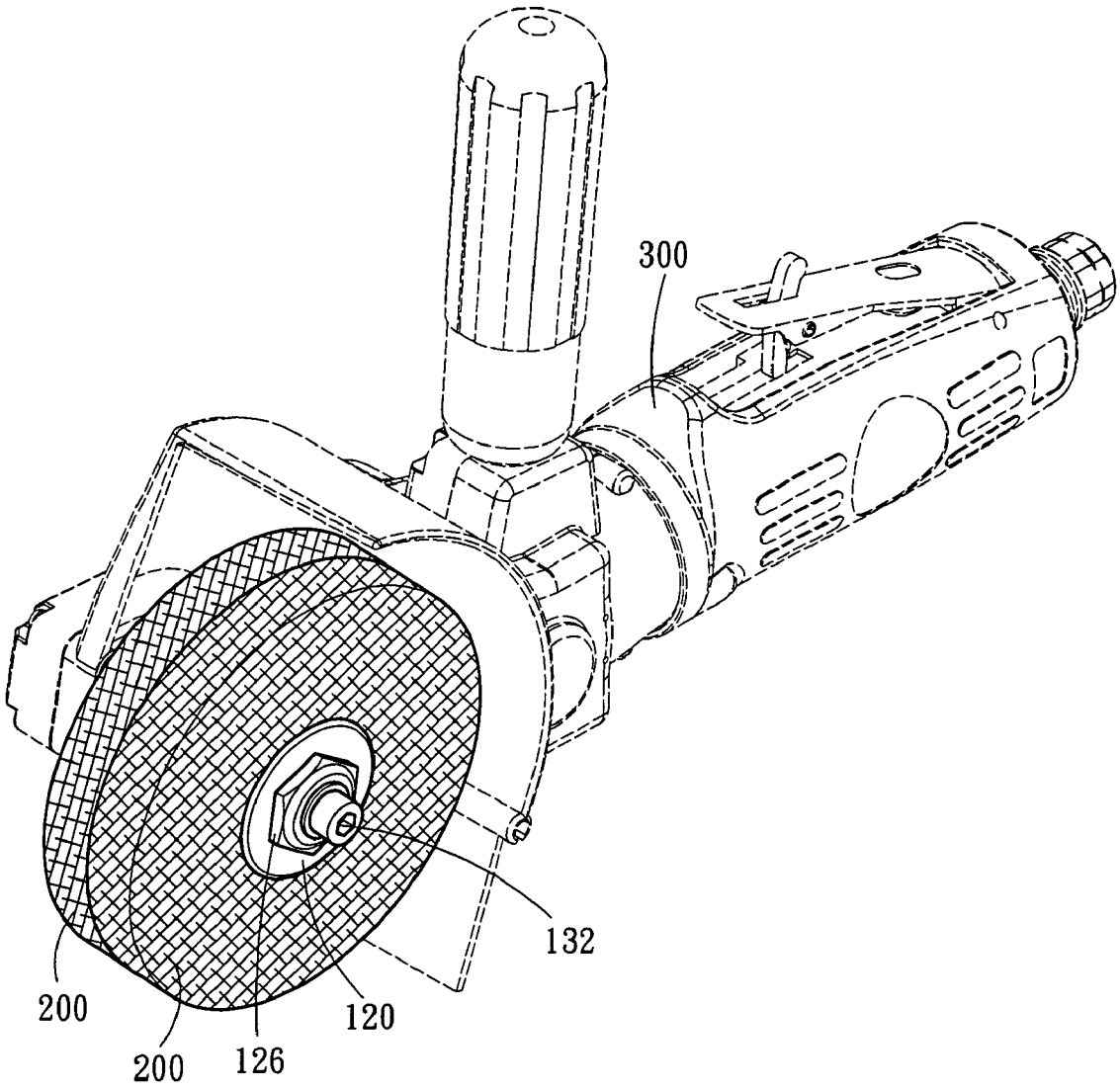
FIG. 2 is a perspective view of the present invention fastened to a pneumatic tool.
Figure 3:
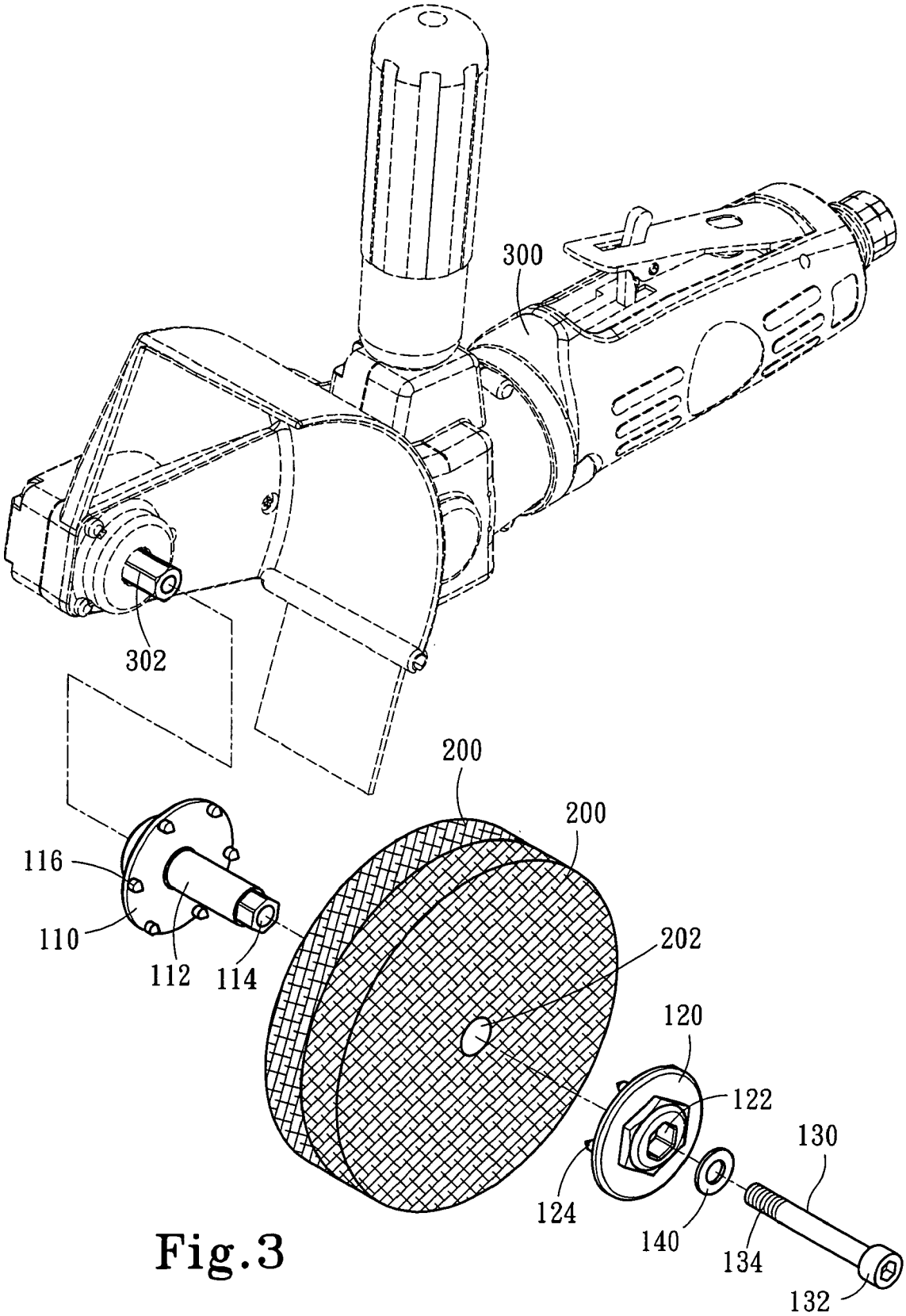
FIG. 3 is an exploded view of the present invention.
Figure 4:
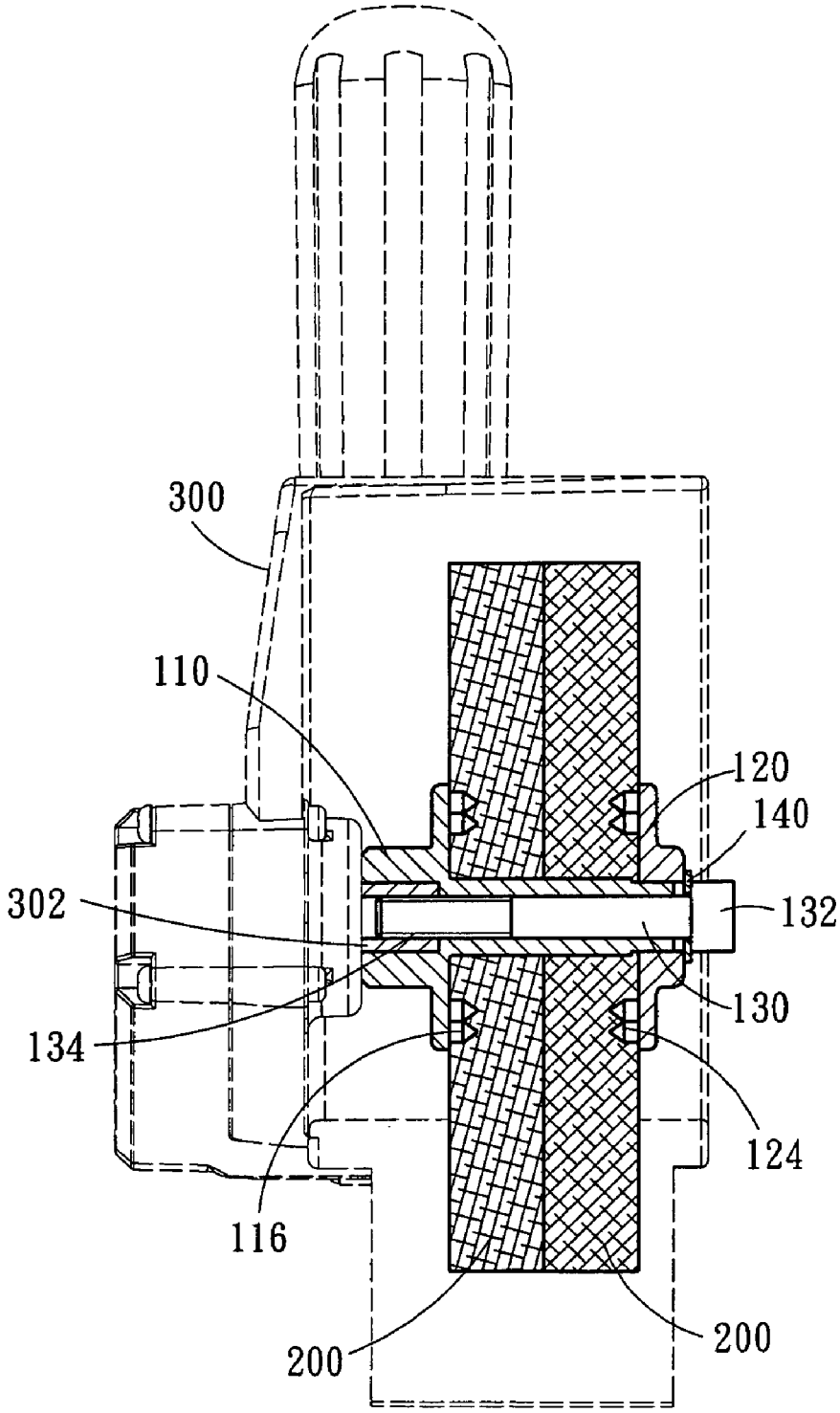
FIG. 4 is a side view of the present invention fastened to a pneumatic tool.

Please referring to FIGS. 2, 3 and 4, the coupling structure for grinding members according to the invention aims to couple at least one grinding member 200 to a pneumatic tool 300. In an embodiment of the invention, the coupling structure mainly includes a first clamping disk 110, a second clamping disk 120 and a fastening element 130.

The first clamping disk 110 has a sleeve 112 extended from the center of one side. The sleeve 112 has a first aperture 114 running through the first clamping disk 110. The sleeve 112 can run through an opening 202 formed in the center of the grinding member 200. The second clamping disk 120 has a second aperture 122 in the center. The sleeve 112 runs through the grinding member 200 and the second aperture 122 of the second clamping disk 120. The fastening element 130 can run through the first aperture 114 and the second aperture 122 to hold the grinding member 200 between the first clamping disk 110 and the second clamping disk 120, thereby to fasten the grinding member 200 to the pneumatic tool 300. In this embodiment, the fastening element 130 is a bolt which has a head 132 to be driven by a hand tool (not shown in the drawings) and a tail end formed with a screw thread 134 to be fastened to a coupling head 302 of the pneumatic tool 300. By fastening the fastening element 130 to the coupling head 302, the first clamping disk 110 and the second clamping disk 120 may be clamped tightly. In addition, a washer 140 may be deployed between the head 132 of the fastening element 130 and the second clamping disk 120 to increase the fastening effect. To those skilled in the art, the fastening element 130 is not limited to the bolt. A latch tenon may also be used. Moreover, the first clamping disk 110 and the second clamping disk 120 may be made of aluminum or an aluminum alloy that has a greater structural strength.

Referring to FIGS. 2 and 3, in this embodiment, the distal end of the sleeve 112 remote from the first clamping disk 110 and the second aperture 122 of the second clamping disk 120 to be coupled therewith are formed respectively in a mating hexagonal shape (or other geometric shape that can form an interference) to increase the fastening effect between the sleeve 112 and the second clamping disk 120, and prevent the sleeve 112 from slipping in the second aperture 122 when the grinding member 200 rotates at a high speed. In addition, the second clamping disk 120 around the second aperture 122 forms a polygonal flange 126 (such as a hexagonal shape shown in FIG. 2) to facilitate clamping of a hand tool to prevent relative movement between the fastening element 130 and the second clamping disk 120 during fastening of the fastening element 130.

Referring to FIGS. 3 and 4, in this embodiment, the first clamping disk 110 and the second clamping disk 120 further have a plurality of lugs 116 and 124 on the surfaces in contact with the grinding member 200. Upon fastening the fastening element 130, the lugs 116 and 124 are slightly sunk in the grinding member 200 to increase the clamping effect of the first clamping disk 110 and the second clamping disk 120.

By means of the construction set forth above, the coupling structure for grinding members according to the invention can provide at least the following benefits:

1. The coupling structure is removable, thus one or more grinding member may be coupled and replaced to enhance the practicality.
2. As the coupling structure is removable, it can be used repeatedly after the grinding member has been replaced, hence the cost is reduced.

While the preferred embodiments of the invention have been set forth for the purpose of disclosure, modifications of the disclosed embodiments of the invention as well as other embodiments thereof may occur to those skilled in the art. Accordingly, the appended claims are intended to cover all embodiments which do not depart from the spirit and scope of the invention.

What is claimed is:

1. A coupling structure for grinding members to fasten at least one grinding member to a pneumatic tool, comprising:

a first clamping disk which has a sleeve extended from the center of one side to run through the grinding member, the sleeve having a first aperture running through the first clamping disk;

a second clamping disk having a second aperture in the center to receive the sleeve; and a fastening element running through the first clamping disk and the second clamping disk through the first aperture and the second aperture to clamp the grinding member between the first clamping disk and the second clamping disk and fasten the grinding member to the pneumatic tool, the sleeve has a distal end remote from the first clamping disk formed in a polygonal manner, the second aperture being formed in the polygonal manner mating with the distal end of the sleeve to increase the fastening effect of the sleeve and the second clamping disk.

2. The coupling structure of claim 1, wherein the first clamping disk and the second clamping disk have respectively a plurality of lugs on a surface in contact with the grinding member to increase the clamping effect of the first clamping disk and the second clamping disk.

3. The coupling structure of claim 1, wherein the fastening element has a head to facilitate operation, the head and the second clamping disk being interposed by a washer to enhance the fastening effect.

4. The coupling structure of claim 1, wherein the fastening element is a bolt.

5. The coupling structure of claim 1, wherein the first clamping disk and the second clamping disk are made of aluminum.

6. The coupling structure of claim 1, wherein the first clamping disk and the second clamping disk are made of an aluminum alloy.

7. A coupling structure for grinding members to fasten at least one grinding member to a pneumatic tool, comprising:

a first clamping disk which has a sleeve extended from the center of one side to run through the grinding member, the sleeve having a first aperture running through the first clamping disk;

a second clamping disk having a second aperture in the center to receive the sleeve; and a fastening element running through the first clamping disk and the second clamping disk through the first aperture and the second aperture to clamp the grinding member between the first clamping disk and the second clamping disk and fasten the grinding member to the pneumatic tool, the second clamping disk having a polygonal flange around the second aperture.

8. The coupling structure of claim 7, wherein the first clamping disk and the second clamping disk have respectively a plurality of lugs on a surface in contact with the grinding member to increase the clamping effect of the first clamping disk and the second clamping disk.

9. The coupling structure of claim 7, wherein the fastening element has a head to facilitate operation, the head and the second clamping disk being interposed by a washer to enhance the fastening effect.

10. The coupling structure of claim 7, wherein the fastening element is a bolt.

11. The coupling structure of claim 7, wherein the first clamping disk and the second clamping disk are made of aluminum.

12. The coupling structure of claim 7, wherein the first clamping disk and the second clamping disk are made of an aluminum alloy.

* * * * *